US008844179B2

(12) United States Patent
Pendlebury

(10) Patent No.: US 8,844,179 B2
(45) Date of Patent: Sep. 30, 2014

(54) APPARATUS AND METHOD OF BACKLIGHTING LARGE FORMAT GRAPHICS

(75) Inventor: Steven Paul Pendlebury, Richmond, VA (US)

(73) Assignee: Electro-LuminX Lighting Corporation, Richmond, VA (US)

( * ) Notice: Subject to any disclaimer, the term of this patent is extended or adjusted under 35 U.S.C. 154(b) by 53 days.

(21) Appl. No.: 13/451,583

(22) Filed: Apr. 20, 2012

(65) Prior Publication Data

US 2012/0266507 A1 Oct. 25, 2012

Related U.S. Application Data

(60) Provisional application No. 61/517,665, filed on Apr. 25, 2011.

(51) Int. Cl.
*G09F 13/22* (2006.01)

(52) U.S. Cl.
CPC ..... *G09F 13/22* (2013.01)
USPC ..... 40/544; 40/624

(58) Field of Classification Search
USPC ..... 40/544, 595
See application file for complete search history.

(56) References Cited

U.S. PATENT DOCUMENTS

| | | | | |
|---|---|---|---|---|
| 6,769,138 | B2 | 8/2004 | Golle et al. | |
| 7,128,449 | B2 | 10/2006 | Golle et al. | |
| 7,144,127 | B2 | 12/2006 | Golle et al. | |
| 7,147,339 | B2 | 12/2006 | Golle et al. | |
| 7,229,183 | B2 | 6/2007 | Golle et al. | |
| 7,229,184 | B2 | 6/2007 | Golle et al. | |
| 7,281,813 | B2 | 10/2007 | Golle et al. | |
| 7,306,345 | B2 | 12/2007 | Golle et al. | |
| 7,316,491 | B2 | 1/2008 | Golle et al. | |
| 7,422,340 | B2 | 9/2008 | Golle et al. | |
| 7,478,935 | B2 | 1/2009 | Golle et al. | |
| 7,690,049 | B2 | 4/2010 | Golle et al. | |
| 7,735,152 | B2 | 6/2010 | Golle | |
| 7,841,021 | B2 | 11/2010 | Golle et al. | |
| 2008/0155869 | A1 * | 7/2008 | Golle et al. | 40/544 |
| 2010/0043263 | A1 * | 2/2010 | Golle | 40/544 |
| 2010/0046198 | A1 * | 2/2010 | Hoffman | 362/84 |
| 2010/0122479 | A1 * | 5/2010 | Golle | 40/215 |

* cited by examiner

*Primary Examiner* — Kristina Junge
(74) *Attorney, Agent, or Firm* — Thomas, Karceski & Karmilovich, P.C.

(57) ABSTRACT

A backlight section is adapted for use in connection with a large format graphic illumination system. The backlight sheet has one or more electroluminescent panels attached to it. This backlight sheet will be mounted onto a display surface. The graphic sheet is then mounted over the assembled backlight sheet having the electroluminescent panels thereon.

12 Claims, 9 Drawing Sheets

APPARATUS AND METHOD OF BACKLIGHTING LARGE FORMAT GRAPHICS

This application claims the benefit of U.S. Provisional Patent Application No. 61/517,665, filed Apr. 25, 2011, which is incorporated herein by reference in its entirety.

This invention relates to a method of backlighting large format graphics with electroluminescent lamps. Specifically, the apparatus and method include a separate backlight section and large format graphic sheet.

BACKGROUND

Large format graphics are commonly displayed throughout the country on such display surfaces as billboards or the sides of buildings or other large structures. These graphics are used in advertising to communicate messages, typically around consumer brands. In some examples, the graphics are illuminated to allow for viewing in dark conditions where the ambient light is low. This illumination is typically accomplished by using spotlights or other forms of direct lighting that shine onto the graphics from the front of the graphic. These methods generally illuminate the total graphic and do not pinpoint a particular section of the advertisement. It is difficult or virtually impossible to precisely highlight certain key features of a graphic, for instance, such as a company's brand name. As a result, traditional graphic up-lighting methods are very energy inefficient and contribute to environmental light pollution.

Additionally, traditional billboard lighting systems are very expensive to install and operate. Standard systems can be very heavy requiring strong and expensive structures to be constructed to support the weight of the fixtures in those systems. The large format graphics can be very expensive. In existing backlighting constructions, the lighting is attached to the back of the large format graphics and may cause stretching or other visually unfavorable movement of the graphics sheet. A unitary system that attaches electroluminescent panels to the back of the graphic sheets also creates shipping and installation problems that adversely affect either the graphic sheets, light panels or both.

SUMMARY

Accordingly, it is an object of the present invention to overcome the drawbacks of the foregoing systems and provide a simple to install system that allows efficient backlighting of a large format graphic without pulling or stretching on the graphics sheet of the billboard or large display.

In one example, a backlight section is adapted for use in connection with a large format graphic illumination system that is mounted onto a display surface. The backlight section comprises a backlight sheet and an electroluminescent panel. The backlight sheet has visual placement indicia thereon that corresponds to a location for fixing the electroluminescent panel thereon. The backlight sheet further has registration indicia thereon adapted for mounting a large format graphic over it. A fastener is placed on the backlight sheet proximate the visual placement indicia, the fastener adapted to fix the electroluminescent panel to the plastic sheet. In a further example, the backlight section comprises a plurality of electroluminescent panels, a corresponding plurality of visual placement of indicia on the backlight sheet, and a corresponding plurality of fasteners on the backlight sheet adapted to fix the electroluminescent panels thereto. The fastener may comprise a pressure sensitive adhesive that fixes the electroluminescent panel to the plastic sheet. The backlight section may further comprise a hook and loop fastener on the electroluminescent panel and wherein the fastener on the backlight sheet is a first hook and loop fastener.

In another embodiment, a large format graphic illumination system mounted onto a display surface includes a backlight section and a large format graphic plastic sheet. The backlight section comprises a backlight sheet and an electroluminescent panel. The backlight sheet has visual placement indicia thereon that corresponds to a location for fixing the electroluminescent panel thereon. The backlight sheet further has registration indicia thereon adapted for mounting a large format graphic over it. A fastener on the backlight sheet and proximate the visual placement indicia is adapted to fix the electroluminescent panel to the backlight sheet. The large format graphic plastic sheet comprises a front side, a back side and a translucent section. The backside comprises second registration indicia thereon. The translucent section allows light from the electroluminescent panel to shine through the plastic sheet.

In a further example, a method of mounting a large format graphic illumination system onto a display surface comprises several steps. First, a backlight section is provided. The backlight section comprises a backlight sheet and an electroluminescent panel. The backlight sheet has visual placement indicia thereon that correspond to a location for fixing the electroluminescent panel thereon. The backlight sheet further has registration indicia thereon adapted for mounting a large format graphic over it. The backlight sheet has a fastener that is proximate to the visual placement indicia, the fastener adapted to fix the electroluminescent panel to the backlight sheet. The next step of the process is mounting the backlight section onto a display surface. Next there is provided a large format graphic sheet that comprises a front side, a back side and a translucent section, wherein the backside comprises a second registration indicia thereon. This large format graphic plastic sheet is then mounted onto the display surface and over the backlight section, wherein the respective registration indicia are substantially aligned with each other, and the electroluminescent panel is adjacent the translucent section.

DETAILED DESCRIPTION

As will be explained herein, the present invention is directed to a backlighting sheet that is mounted onto a display surface behind a separate, large format graphic sheet. The backlighting sheet has electroluminescent panels mounted directly to it. The large format graphic sheet is then mounted over the display surface and over the backlighting sheet. In this way, the large format graphic sheet may be shipped and handled separately from the backlighting illumination system that includes the backlight sheet with the electroluminescent panels mounted thereon. In one example, the backlight sheet may itself be separately shipped and handled from the electroluminescent panels. The electroluminescent, panels would be mounted after the backlight section was already mounted onto a display surface.

An example of a large format graphic illustration system mounted onto a display surface, in this example a billboard, will be described with reference to FIGS. 1-9.

Figure 1:
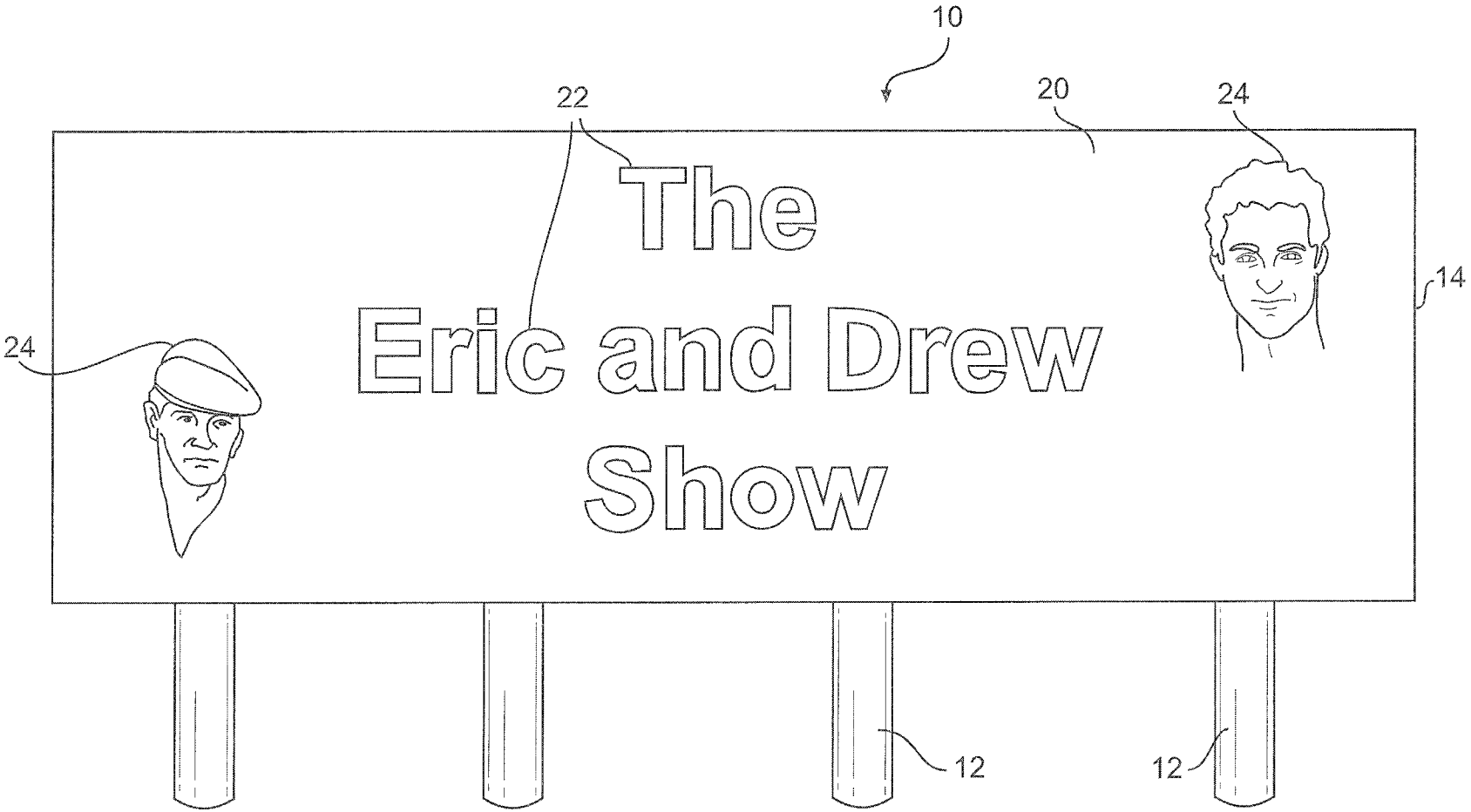
FIG. 1 is a front elevation view of a billboard in accordance with an example of the invention under regular, ambient daylight.

Turning first to FIG. 1, there is a billboard 10 that includes a rectangular display surface 14 and a large format graphic sheet 20 mounted on the display surface. The billboard 10 is held up by conventional poles 12. The graphic sheet 20 includes images 24 and advertising indicia 22, in this case the advertising indicia are the words "The Eric and Drew Show." The billboard 10 in FIG. 1 is shown in regular, ambient daylight. The images 24 and advertising words 22 are visible as they would be shown in the daylight.

Figure 2:
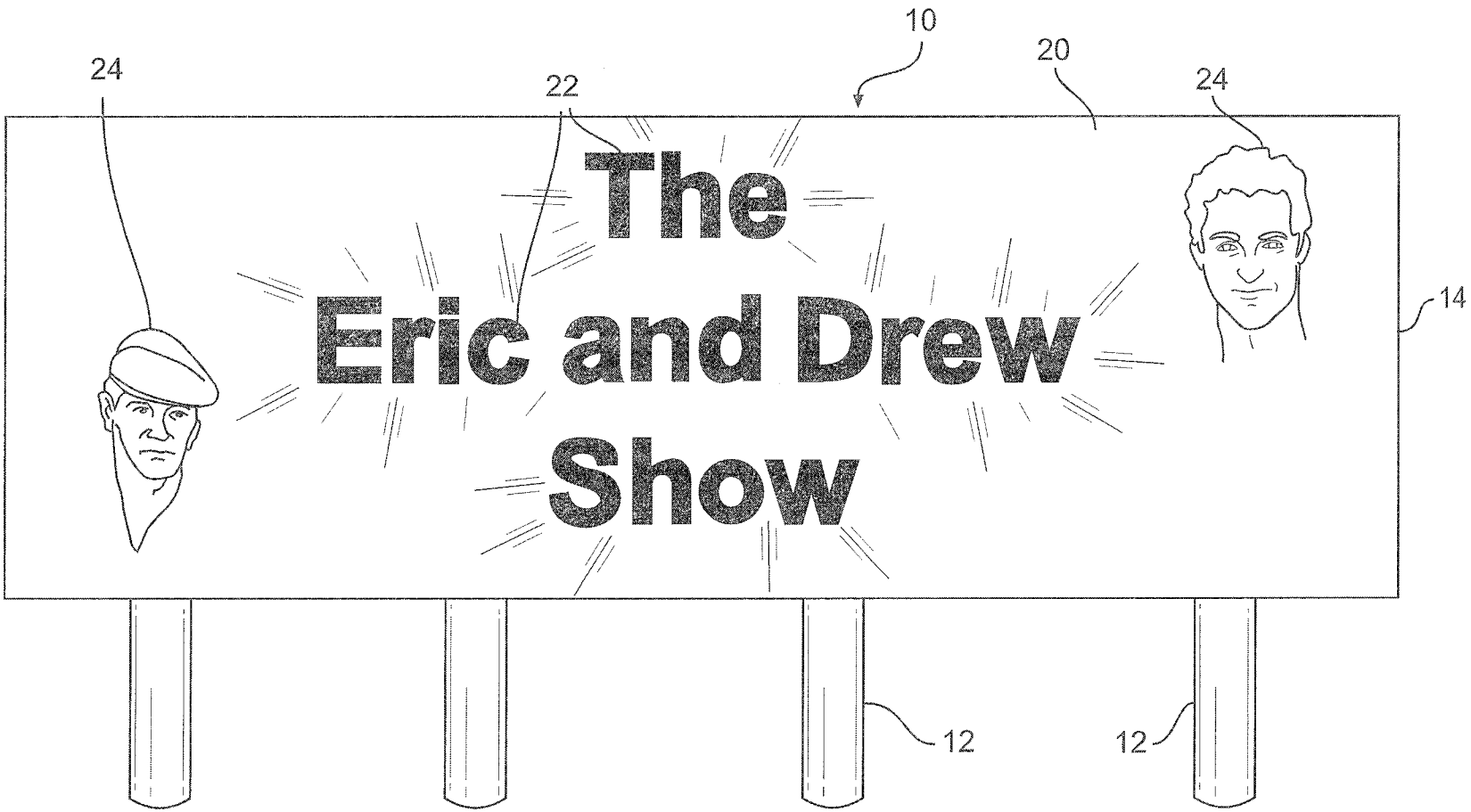
FIG. 2 is a front elevation view of the same billboard, as shown in FIG. 1 except the view is taken in the dark where the words are shown as being backlighted.

FIG. 2 is the same billboard 10 as FIG. 1 except it is shown in the dark or night. The images 24 are unchanged and unlit. However, the advertising indicia, the words "The Eric and Drew Show," are backlighted so that they may be visible in the dark at night.

Figure 3:
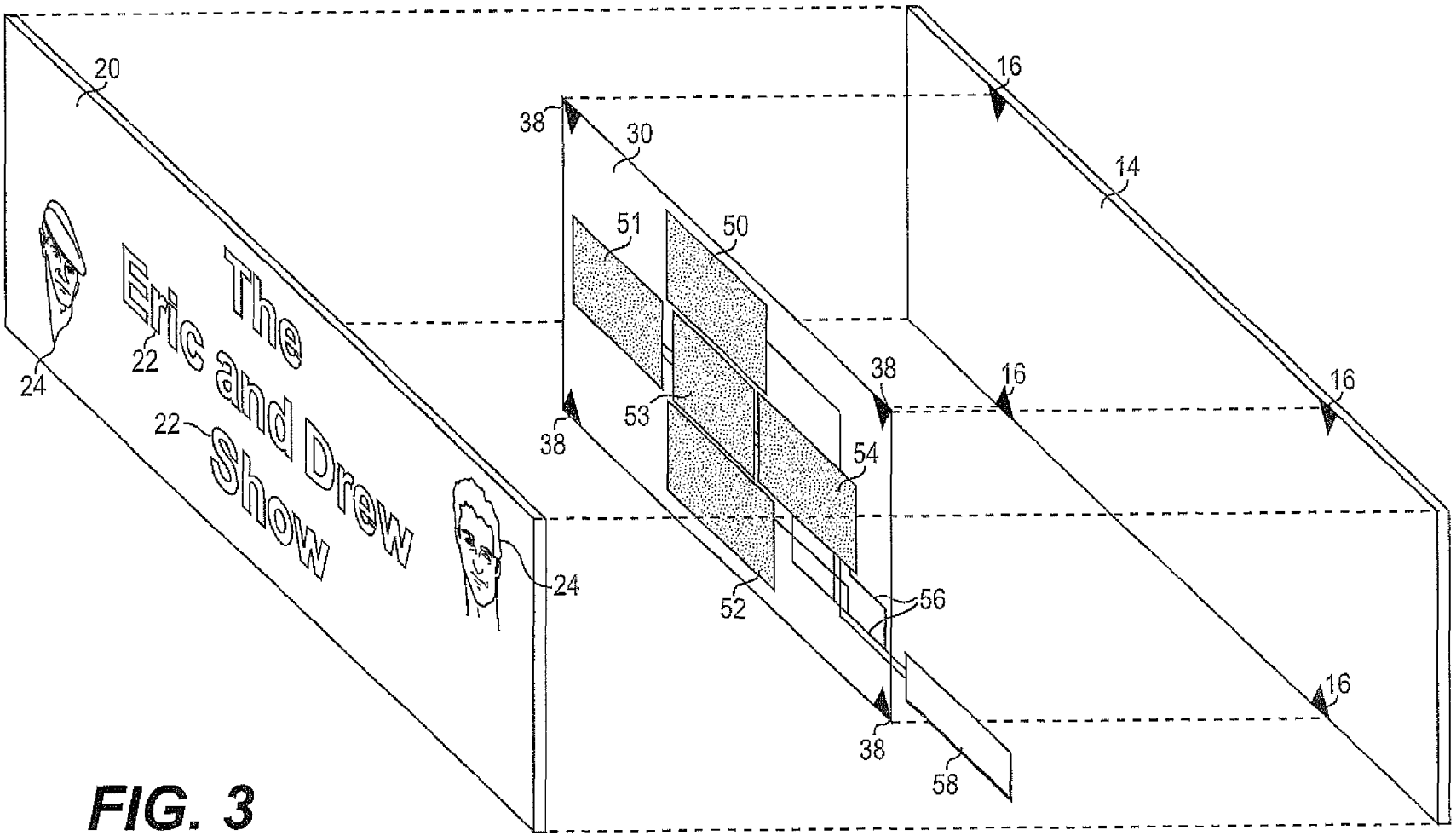
FIG. 3 is a perspective, exploded view of three primary components utilized in examples of the present invention.

FIG. 3 is an exploded view of the front graphic sheet 20, the backlight sheet 30 and the display surface 14, in this example the ad on a billboard. The front graphic sheet 20 includes the images 24 and the advertising words 22—"The Eric and Drew Show," The backlighting sheet 30 includes five rectangular sections 32-36 printed thereon. There are also registration indicia arrows 38 that are printed substantially in the four corners of the backlight sheet 30. The billboard display surface 14 has registration indicia 16 printed thereon. In installation, the registration indicia 16 are lined with the registration indicia 38 on the backlight sheet.

Figure 4:
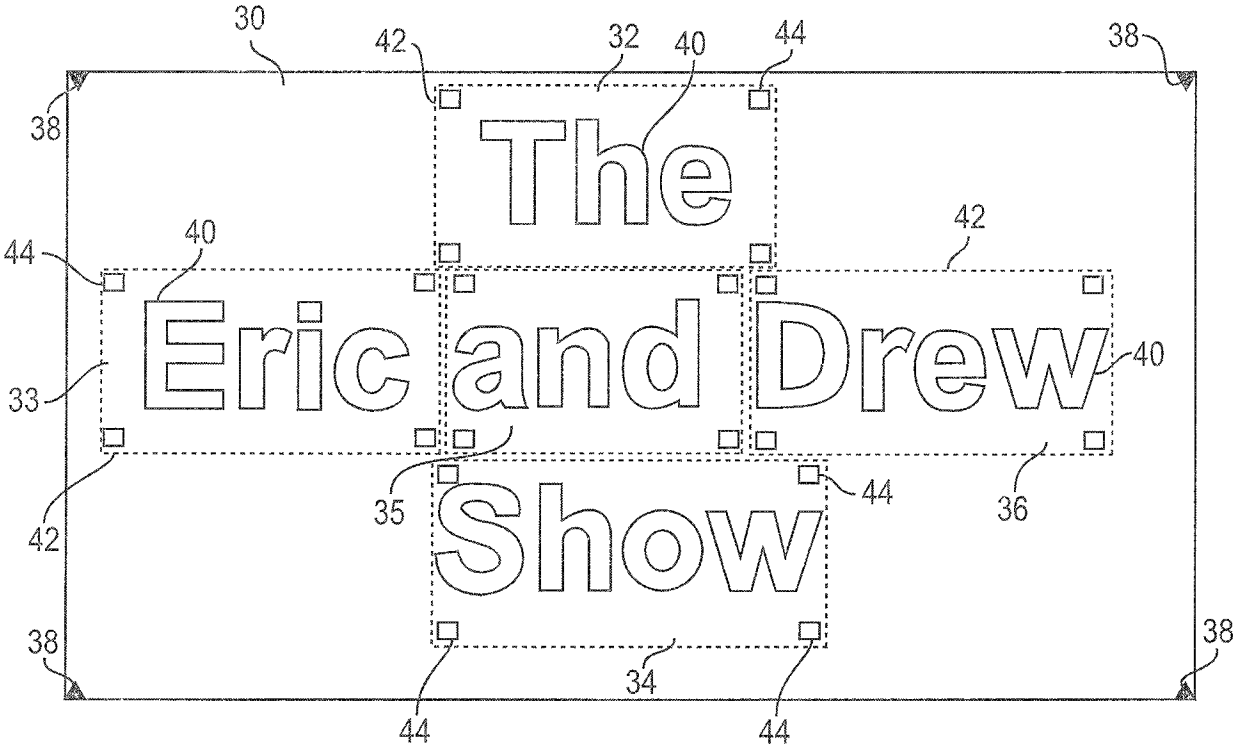
FIG. 4 is a front elevation view of a backlight sheet before any electroluminescent panels are mounted thereon.

FIG. 4 is a front view of the backlight sheet 30 alone. As shown also in FIG. 3, the sheet 30 includes registration indicia arrows 38 printed in the four corners thereof to facilitate the coil ect placement of the backlight sheet 30 onto a billboard display surface and for guiding the mounting of a graphic sheet 20 thereover. Each of the sections 32-36 has a rectangular outline 42 around it. In the corner of each rectangular outline 42 are adhesive patches 48. Finally, the written advertising words 40 are shown in print, on the backlight sheet—"The Eric and Drew Show." The rectangular outlines 42 and the adhesive patches 44 are used to direct the application of electroluminescent light panels thereon. The printed words 40 are merely additional guidance to help the alignment and mounting of electroluminescent panels onto the backlight sheet 30.

Figure 5:
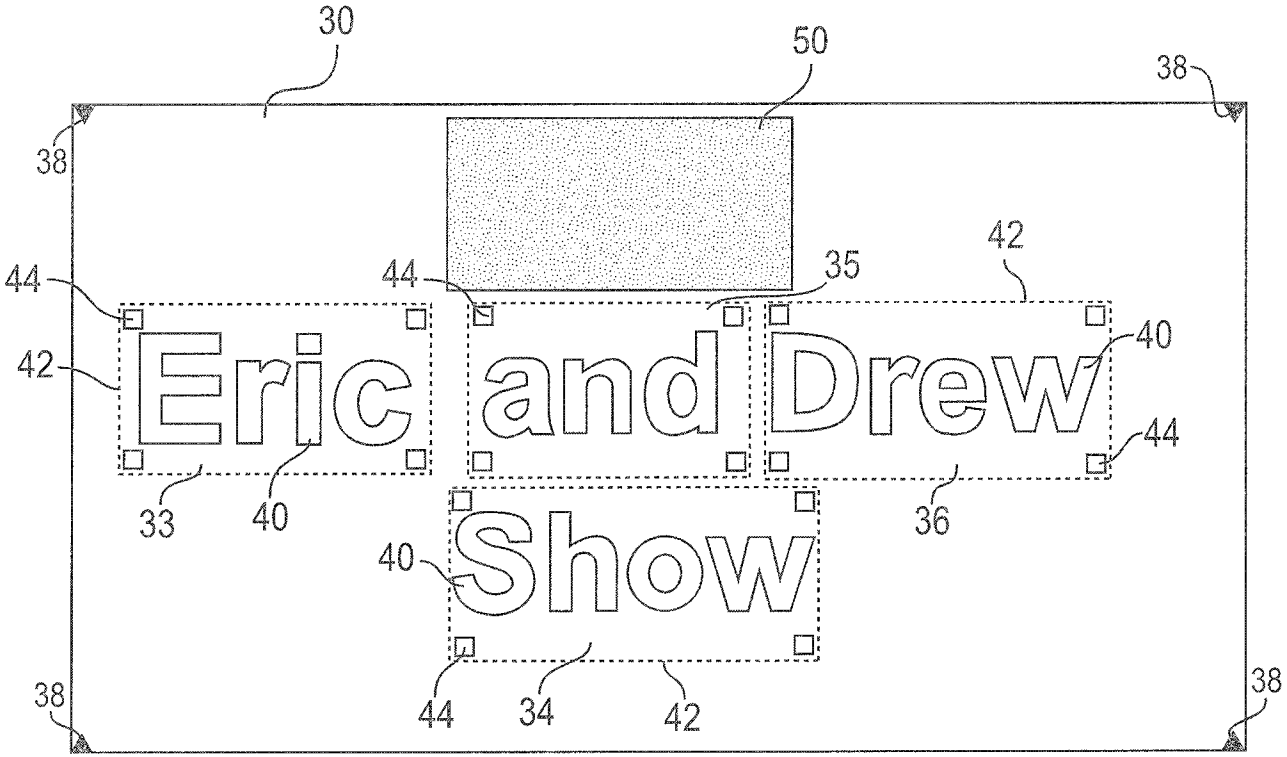
FIG. 5 is a front elevation view of the backlight sheet with one of the electroluminescent panels mounted thereon.

FIG. 5 demonstrates a single electroluminescent panel 50 mounted over the rectangular section 32 (no longer visible). Otherwise, FIG. 5 is identical to FIG. 4. As is demonstrated, the electroluminescent panel is adhered over the rectangular section 32 (not shown) either before or after the backlight sheet 30 is placed onto a display surface.

Figure 6:
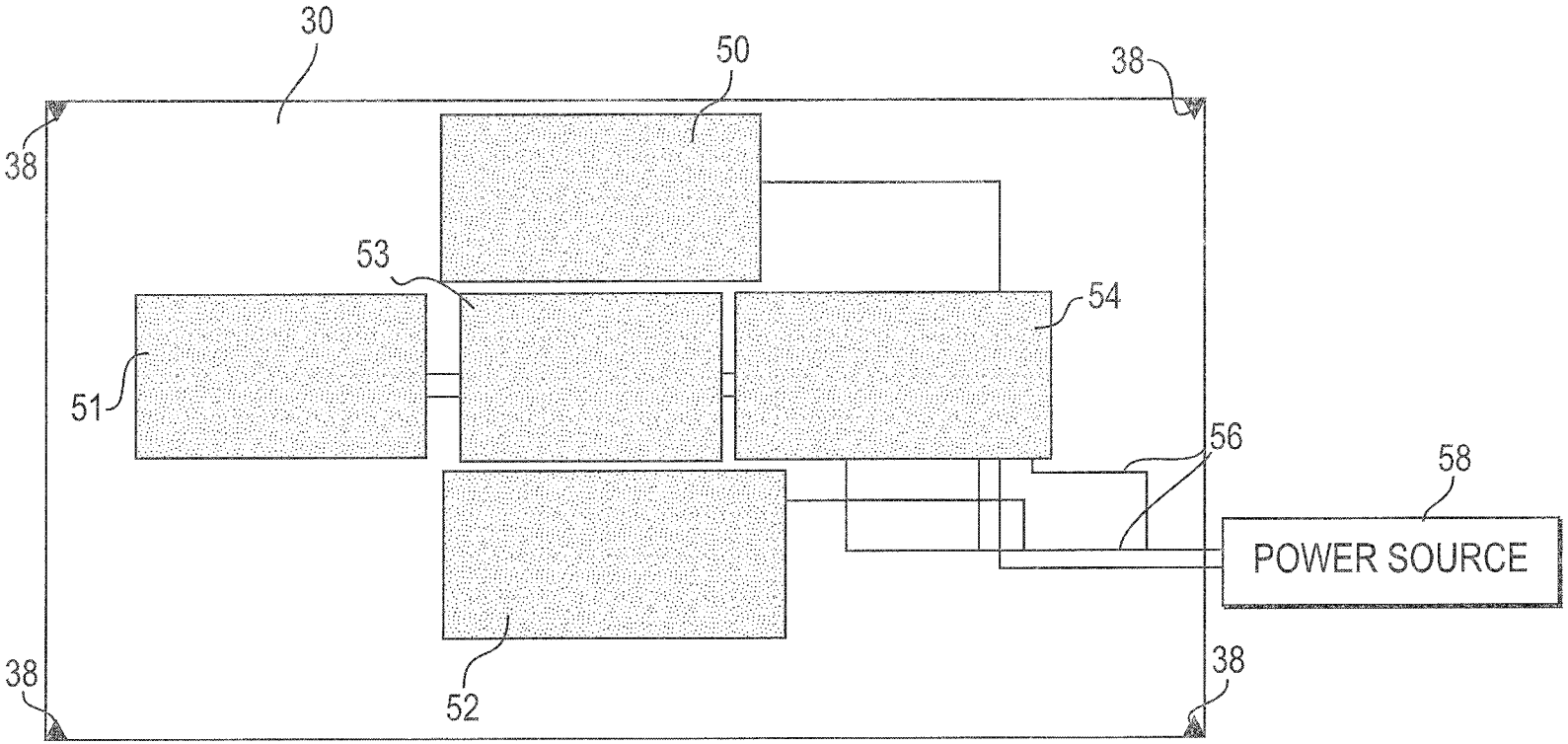
FIG. 6 is a front elevation view of the backlight sheet with five electroluminescent panels mounted thereon.

FIG. 6 is a front view of the backlight sheet 30 with electroluminescent panels 50-54 mounted over the sections 32-36 (no longer visible). Wires 56 extend from each electroluminescent panel 50-54 and are connected to a power source 58. The power source 58 may be a battery, it may be a generator or other standalone power source. The power source 58 may be connected to a regular public power grid. At present, it is functionally necessary that the power source 58 does require a transformer to safely power the electroluminescent panels 50-54.

Figure 7:
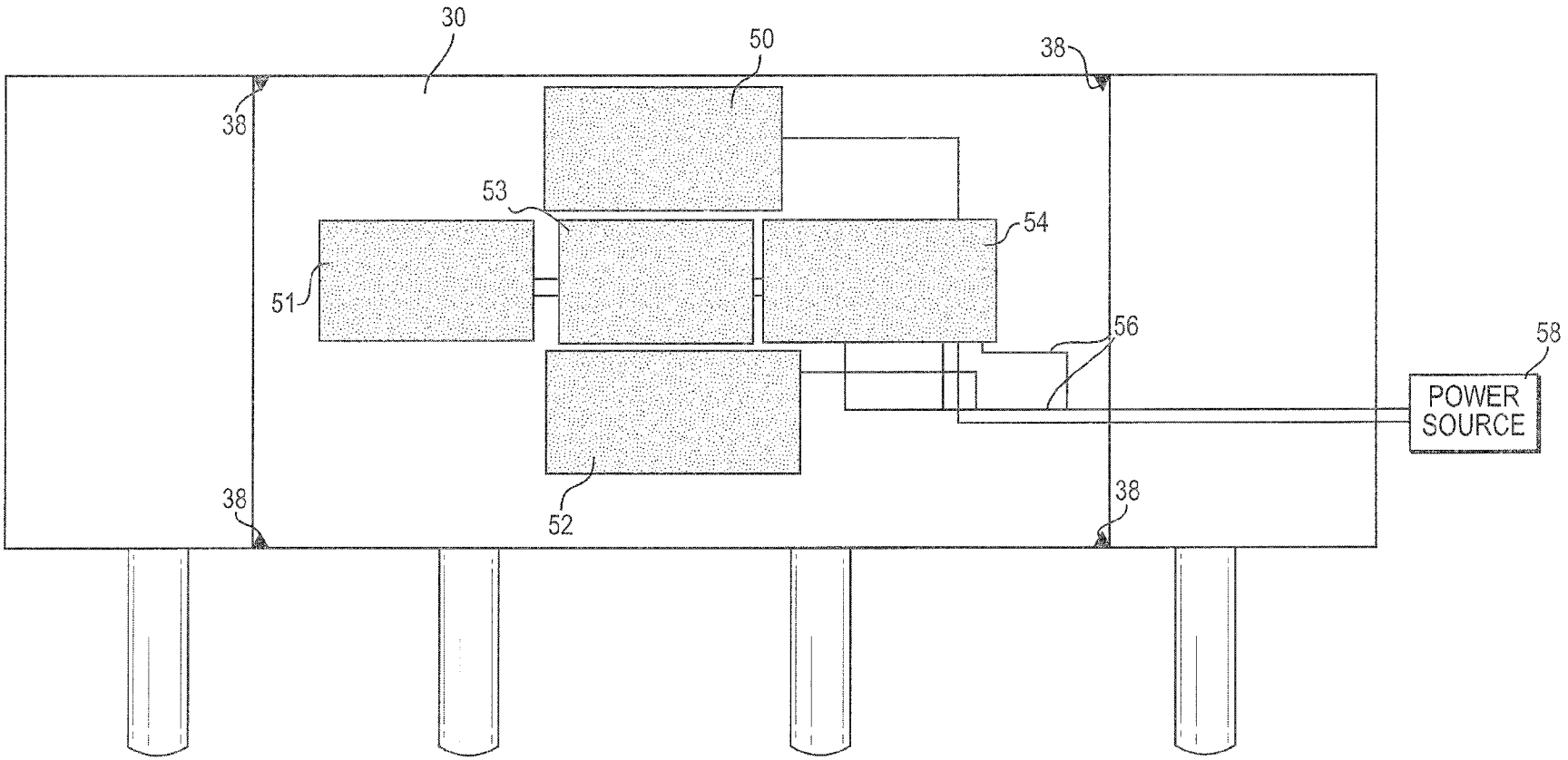
FIG. 7 is a front elevation view of the backlight sheet mounted onto a billboard display surface.

FIG. 7 is a front view of a billboard 10 as shown in FIGS. 1 and 2 with the large format graphic sheet 20 removed from view.

Figure 8:
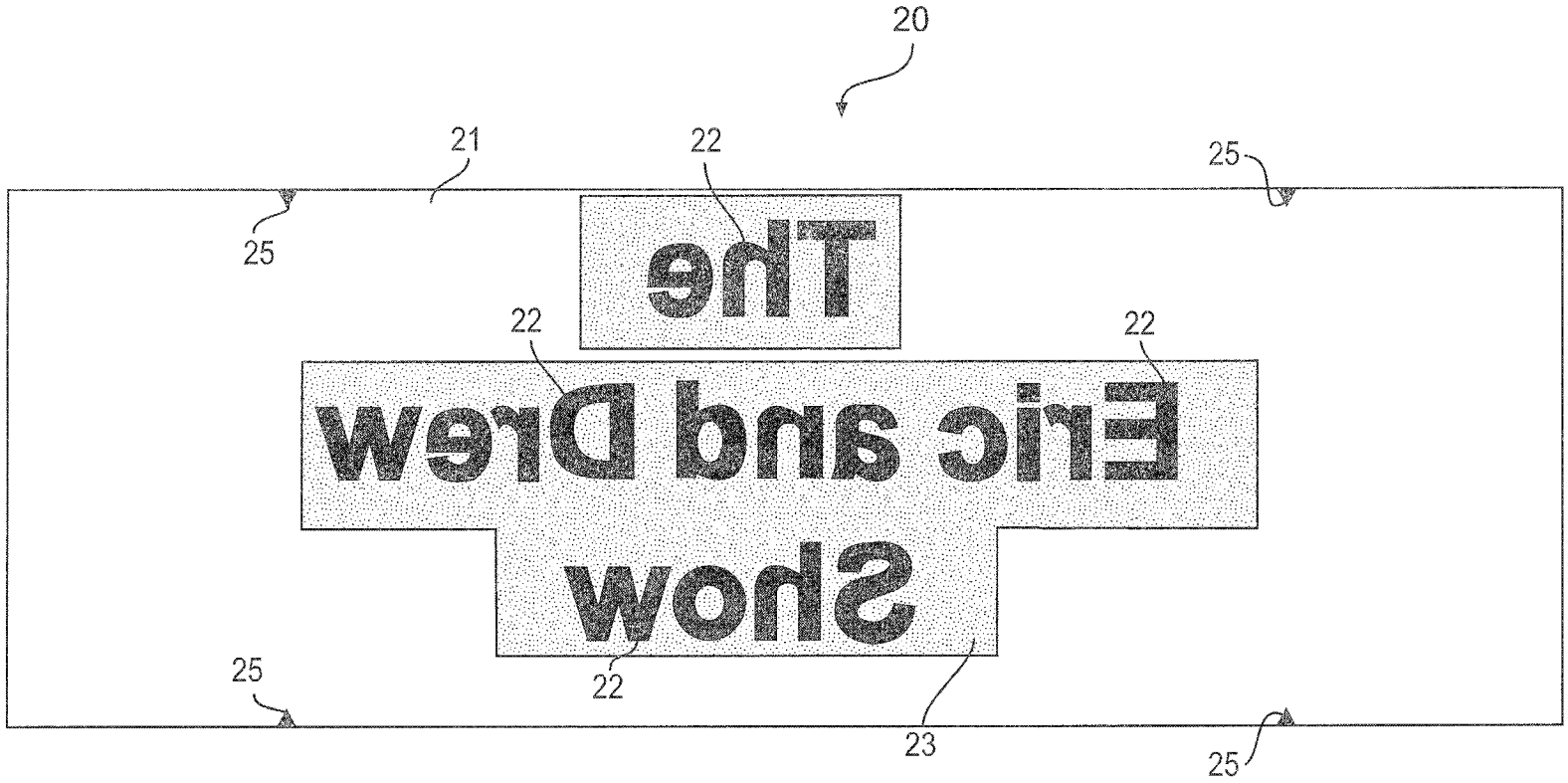
FIG. 8 is an elevation view of the back side of the front graphic display sheet.

FIG. 8 is a front view of the backside 21 of the graphic sheet 20. The backside 21 shows the reverse image of the advertising indicia words 22—"The Eric and Drew Show." The letters 22 are translucent or transparent in nature to allow light to shine through those letters. In order that those letters 22 are crisp and bright, the backside 21 has black or opaque ink 23 printed thereon outlining and defining those letters 22. This blackout ink 23 may be contoured to the shapes or letters being outlined with enough area to reasonably block most light from the electroluminescent, panel. Also evident on the backside 21 are registration indicia arrows 25 that, during installation, would line up with the registration indicia arrows 38 on the backlight sheet 30. In this way, the electroluminescent panels 50-54 are accurately aligned behind the words 22 so that the light can show clearly therethrough.

Figure 9:
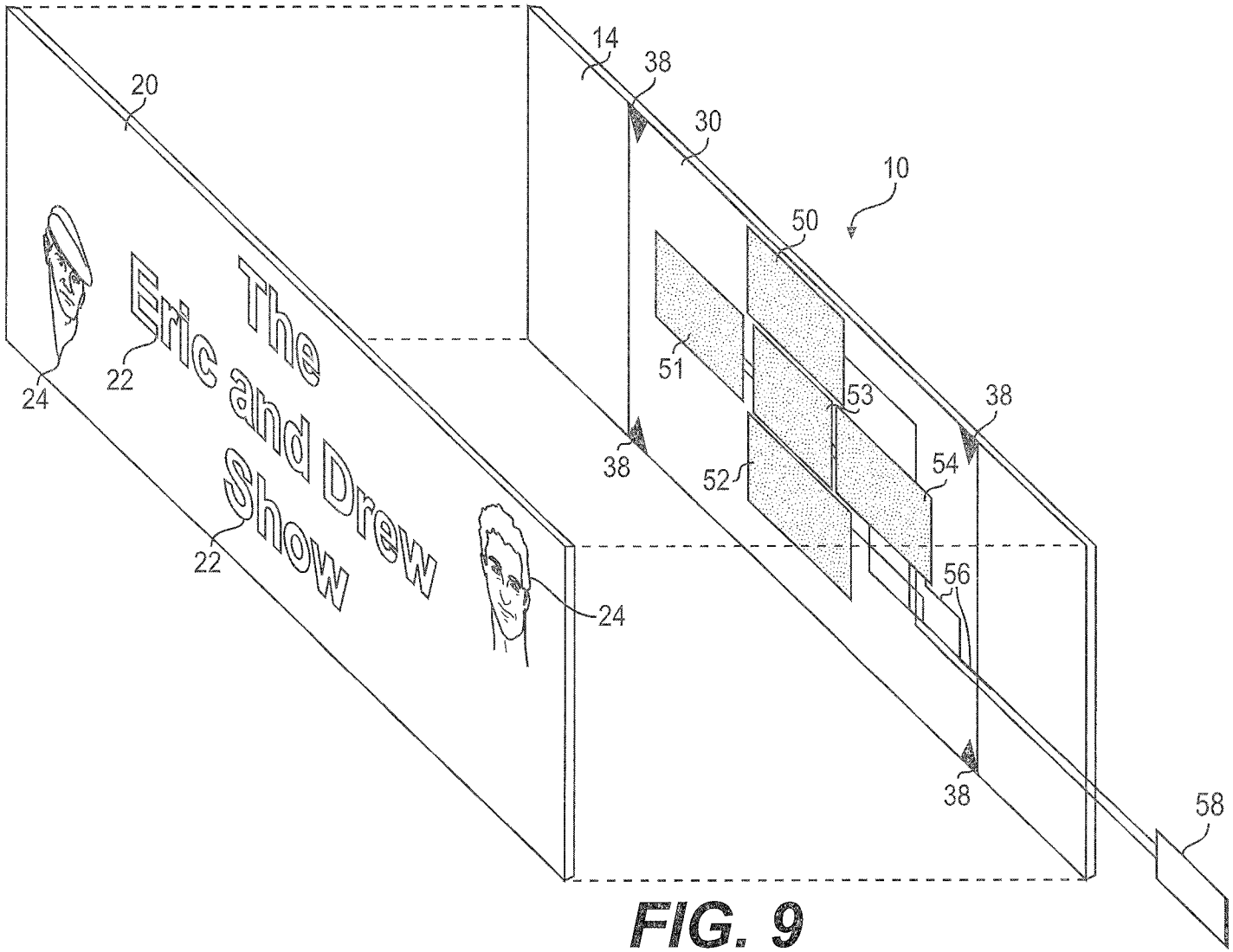
FIG. 9 is a perspective view of the front graphic sheet exploded from the billboard display panel that has a backlighting sheet already mounted thereon.

Finally, FIG. 9 shows an exploded view of the front graphic sheet 20 as it would be mounted onto the billboard display surface 14 that already has the backlight sheet 30 mounted thereon.

The display surface 14 as shown in the attached figures is a generally flat billboard surface. This display surface may be all or only a portion of a billboard. Additionally, the display surface may be any large surface of any shape over which a large graphic is mounted. For instance, the side of large surfaces including the sides of building or other architectural structures may be advantageous display surfaces. The display surface described herein could be any one of those types of surfaces or other large surfaces and have any geometric shape.

The large format graphic sheet, shown in this example as sheet 20, is typically a vinyl or other type of plastic sheet that is mounted on a billboard or otherwise hung onto a display surface. The graphic sheet may alternatively be comprised of various materials including, but not limited to the following: fabric, glass and metal or metal-coated film. Importantly, the large format graphic sheet 20 must include a translucent portion. In the examples in the attached figures, the translucent portion is the letters and words 22 that make up the tagline "The Eric and Drew Show." This is the portion of the example where backlighting provided by electroluminescent lights is allowed to shine through the graphic sheet. The term translucent may also include substantially transparent. This section may also be tinted or substantially clear depending on the artistic requirements of the graphic sheet and the message being delivered. The translucent portion may be multiple different degrees of transparent in that there may be transparent sections and greatly reduced lighting sections. Finally, the graphic sheet as discussed herein is shown as rectangular in shape. The graphic sheet may be any geometric shape, symmetric of asymmetric, depending on the desired message and display surface.

The backlight sheet may be made of any material including, for instance, plastic or paper or coated paper. In this application, the term "backlight sheet" refers to any support web including woven and netting material in addition to plastic film, paper and glass sheets. For the sake of cost effectiveness, the backlight sheet can be made of inexpensive plastic, because the sheet will be covered over by the large format graphic sheet. The integrity of the backlight sheet needs to be solid enough to caller the weight of electroluminescent panels and otherwise withstand the environmental conditions where the large graphic sheet will be mounted. The backlight sheet may also be smaller in size than the large graphic sheet, because it only backs the portion of the graphic sheet to be illuminated. Although not shown in the drawings, it is possible to have two or more backlight sheets and light panels behind a single large graphic sheet with different backlight sheets behind different portions of the large graphic sheet.

Electroluminescent panels are any type of thin electric lighting that is traditionally referred to as an electroluminescent light panel. These are favored, because they may be mounted behind a large format graphic sheet without significantly deforming the large format graphic sheet. These panels will be connected using electrical wires to a power source that may be an on-site source or a regular power grid. And while the power source is discussed generically, it is possible that the panels may be connected to a power source that itself includes or is further connected to a controller. The controller may include a transformer and surge protector and programmable functions. For instance, if there are a plurality of electroluminescent panels, those panels may be separately connected to one or more controllers and power sources. Additionally, one or more controllers may switch panels off and on to facilitate dynamic lighting effects.

The adhesive patches that are mounted on to the backlight sheet and/or the electroluminescent panels may be adhesive patches or some other pressure sensitive material. They may also be hook and loop fasteners on both the panels and the backlight sheet. The fasteners may also be hooks or snaps or some other method of fixing electroluminescent panels onto the backlight sheet.

The visual placement indicia on the backlight sheet are guides to assist in the installation or mounting of the electroluminescent panel or panels onto the backlight sheet. There is often an outline that may be used as shown in the attached figures. Alternatively, there may be a color code or some other visual cue that clearly communicates where the electroluminescent panels will be mounted. In the examples on the attached drawings, the graphic message that is in the design and format of the message on the translucent portion of the graphic sheet may be reprinted on the backlight sheet just to provide a backup assurance regarding the alignment of the electroluminescent panels in fixing them on the backlight sheet. Alternative indicia may include more technically specific details regarding the lighting including the color and dimensions of the particular electroluminescent panel that will be placed in a given spot designated by the visual placement indicia.

The registration indicia may be placed on two or more places in the system described herein. It is most important that the registration indicia are marked onto the backlight sheet and the large format graphic sheet. This allows the backlight sheet to be reliably aligned with the large format graphic sheet, thereby correctly aligning the electroluminescent panels behind the translucent sections of the large format graphic sheet. These registration indicia may be in any form of a line, arrow, or other visual cue that allows the installer to accurately mount the system.

With respect to methods of installation of the system, the large format graphic sheet is typically provided separately from the backlight sheet. In a 3-step method, the graphic sheet, backlight sheet and electroluminescent panels are all shipped separately to an installation site. The installer then first mounts the backlight sheet. Second, the electroluminescent panels are then mounted onto the backlight sheet. Finally, the graphic sheet is mounted over the backlight sheet and electroluminescent panel combination. Alternatively, the electroluminescent panel can be fixed to the backlight sheet before shipment to an installation site. There may be additional care required in such shipment. However, either 2-step or 3-step method of site installation may be used.

Depending on the type of installation, there are shipment options for the system described. The graphic sheet may be shipped separately to the installation site. The backlight sheet may be shipped separately. Typically, these flexible sheets will be shipped in rolls for ease of shipment and to protect the particular graphics on the sheets. The electroluminescent panels may be shipped, as noted earlier, separately to the installation site. Alternatively, they may be assembled onto the backlight sheet offsite and then shipped in assembled fashion to the site.

While the invention has been described with reference to specific embodiments thereof, it will be understood that numerous variations, modifications and additional embodiments are possible, and all such variations, modifications, and embodiments are to be regarded as being within the spirit and scope of the invention.

What is claimed is:

1. A backlight section adapted for use in connection with a large format graphic illumination system mounted onto a display surface, the backlight section comprising, a backlight sheet and a plurality of electroluminescent panels supported by the backlight sheet;

the backlight sheet having visual placement indicia thereon that corresponds to a plurality of locations for fixing the electroluminescent panels thereon;

the backlight sheet further having a registration indicia thereon adapted for mounting a large format graphic plastic sheet over it, and wherein the electroluminescent panels will be accurately aligned behind but are not attached to the large format graphic plastic sheet;

and a plurality of fasteners on the backlight sheet and proximate the visual placement indicia, the fasteners adapted to fix the electroluminescent panels to the backlight sheet.

2. A backlight section as described in claim 1, wherein the fastener comprises a pressure sensitive adhesive that fixes the electroluminescent panel to the plastic sheet.

3. A backlight section as described in claim 1, further comprising a second hook and loop fastener on the electroluminescent panel and wherein the fastener on the backlight sheet is a first hook and loop fastener.

4. A backlight section as described in claim 1, wherein the plurality of fasteners comprise a pressure sensitive adhesive that fixes the electroluminescent panels to the backlight sheet.

5. A large format graphic illumination system mounted onto a display surface, the system comprising:

a) a backlight section comprising a backlight sheet and a plurality of electroluminescent panels supported by the backlight sheet;

the backlight sheet having visual placement indicia thereon that corresponds to a plurality of locations for fixing the electroluminescent panels thereon;

the backlight sheet further having a registration indicia thereon adapted for mounting a large format graphic plastic sheet over it, wherein the backlight sheet is not attached to the plastic sheet;

and a plurality of fasteners on the backlight sheet and proximate the visual placement indicia, the fasteners adapted to fix the electroluminescent panels to the backlight sheet; and b) a large format graphic plastic sheet comprising a front side, a back side and a translucent section, wherein the back side comprises a second registration indicia thereon, and wherein the translucent section allows light from the electroluminescent panels to shine through the plastic sheet.

6. A large format graphic illumination system as described in claim 5, wherein the fastener comprises a pressure sensitive adhesive that fixes the electroluminescent panel to the backlight sheet.

7. A large format graphic illumination system as described in claim 5, wherein the translucent section is substantially transparent.

8. A large format graphic illumination system as described in claim 5, wherein the backlight sheet and the large format graphic plastic sheet are mounted adjacent each other and the respective registration indicia are substantially aligned with each other.

9. A method of mounting a large format graphic illumination system onto a display surface, the method comprising the steps of:

first providing a backlight section comprising a backlight sheet and a plurality of electroluminescent panels;

the backlight sheet having visual placement indicia thereon that corresponds to a location for fixing the electroluminescent panels thereon;

the backlight sheet further having a registration indicia thereon adapted for mounting a large format graphic over it;

and a plurality of fasteners on the backlight sheet and proximate the visual placement indicia, the fasteners adapted to fix the electroluminescent panels to the backlight sheet;

mounting the electroluminescent panels onto the backlight sheet;

mounting the backlight section onto a display surface;

next providing a large format graphic plastic sheet comprising a front side, a back side and a translucent section, wherein the back side comprises a second registration indicia thereon, mounting the large format graphic plastic sheet onto the display surface and over the backlight section, but not attached to the backlight section;

wherein the respective registration indicia are substantially aligned with each other, and the electroluminescent panels are adjacent the translucent section.

10. A method as described in claim 9, wherein the fastener comprises a pressure sensitive adhesive that fixes the electroluminescent panel to the backlight sheet.

11. A method as described in claim 9, further comprising a second hook and loop fastener on the electroluminescent panel and wherein the fastener on the backlight sheet is a first hook and loop fastener.

12. A method as described in claim 9, wherein the translucent section is substantially transparent.

* * * * *